United States Patent [19]

Beasley et al.

[11] Patent Number: 4,495,803

[45] Date of Patent: Jan. 29, 1985

[54] METHOD OF MONITORING THE GROWTH OF CUTTINGS BEDS IN ANGLED WELL BORES

[75] Inventors: Roy D. Beasley, Denton; James H. LaGrone, Lake Jackson, both of Tex.

[73] Assignee: Mobil Oil Corporation, New York, N.Y.

[21] Appl. No.: 529,192

[22] Filed: Sep. 6, 1983

[51] Int. Cl.[3] ..... E21B 47/00

[52] U.S. Cl. ..... 73/151; 73/155; 175/42

[58] Field of Search ..... 73/151, 155; 175/42, 175/46

[56] References Cited

U.S. PATENT DOCUMENTS

| | | | |
|---|---|---|---|
| 2,868,506 | 1/1959 | Nestle | 73/155 |
| 2,966,059 | 12/1960 | Dower | 73/155 |
| 3,155,176 | 11/1964 | Bennett | 175/42 |
| 3,690,167 | 9/1972 | Chase, Jr. et al. | 73/155 |

*Primary Examiner*—Howard A. Birmiel
*Attorney, Agent, or Firm*—Alexander J. McKillop; Michael G. Gilman; Charles J. Speciale

[57] ABSTRACT

A method for monitoring efficacy of removal of cuttings generated during drilling of a well is disclosed which features injection of artificial cuttings into the well-drilling fluid at a controlled rate and monitoring the rate of return of the artificial cuttings in the return drilling fluid stream. The relative rate of return with respect to the rate of injection is indicative of the efficacy of removal of the cuttings generated in the drilling process.

6 Claims, 8 Drawing Figures

METHOD OF MONITORING THE GROWTH OF CUTTINGS BEDS IN ANGLED WELL BORES

FIELD OF THE INVENTION

This invention relates to the field of well drilling. More particularly, the invention relates to methods for monitoring the growth and/or erosion of the cuttings beds formed in wells drilled at an angle to the vertical.

BACKGROUND OF THE INVENTION

In recent years the pressure for production of increased oil and gas has led to increased use of wells drilled at angles with respect to the vertical. This is done for a variety of reasons, for example, to effect a wide area of coverage from a single well head, such as an off-shore oil platform. Other reasons for drilling at angles include avoiding drilling through large upthrusts of material located directly over formations of interest, and avoiding having to drill through corrosive material such as found in salt domes. The art recognizes that there are other applications of drilling at angles to the vertical as well.

The typical well drilling procedure, particularly in exploration for oil, gas and other minerals involves the rotation of a drill bit at the end of a long tubular drill string. A drilling fluid or "mud" is pumped down the center of the drill string, to exit around the hollow drill bit, and carries the cuttings drilled from the subsurface formation back to the surface for removal. The mud also provides a cooling effect to the drill head. In a well drilled along the vertical the cuttings are carried to the surface by the mud passing around the drill head on all sides. However, in a well drilled at an angle to the vertical, the tendency is for the mud to flow upwardly along the upper side of the drill string because it is typically of lower density than the metallic drill string. The absence of a mud current on the lower side of the drill string allows a bed of cuttings to build up under the drill string. This can be a severe problem in some cases because the cuttings bed can build up to such an extent that the drill string is distorted and forced into the upper side of the wall of the well. Another problem occurs when one tries to remove the drill head, which is typically of larger diameter than the drill string; the cuttings bed built-up behind the drill head prevents or impedes its removal.

Numerous expedients have been suggested for ensuring that cuttings are removed properly from a well drilled at an angle to the vertical and some of these are successful. However, one area which the art has not addressed is the provision of a method for determining whether the cuttings are, in fact being properly removed from a well, so as to determine whether any of these methods should be used, and, if they are used, whether or not they are working effectively.

OBJECTS OF THE INVENTION

Accordingly, it is an object of the invention to provide a method for determining whether the cuttings are being removed from a well being drilled.

It is a further object of the invention to provide a method for monitoring the growth or erosion of a cuttings bed formed underneath the well string in a well being drilled at an angle to the horizontal.

A further object of the invention is to provide a method for improvement of the efficiency of drilling operations.

SUMMARY OF THE INVENTION

The above mentioned needs of the art and objects of the invention are satisfied by the present invention in which artificial cuttings, i.e., particles of about the same size and density of the cuttings in a well, but which are distinguishable from the cuttings generated by the drilling operation, are injected at a known rate into the mud pumped down through the drill string. The rate of return of the artificial cuttings in the upcoming mud stream is then monitored. If fewer artificial cuttings return than are pumped into the well per unit time, this is an indication that the cuttings are building up in the well and that there may be a problem with a cuttings bed. If more artificial cuttings are removed per unit time than are pumped in this means that the cuttings bed is diminishing; while if the rates of ingoing and outcoming artificial cuttings are similar, it may be presumed that the cuttings are being efficiently removed.

BRIEF DESCRIPTION OF THE DRAWINGS

The invention will be better understood if reference is made to the accompanying drawings, in which.

DESCRIPTION OF THE PREFERRED EMBODIMENTS

Figure 1A:
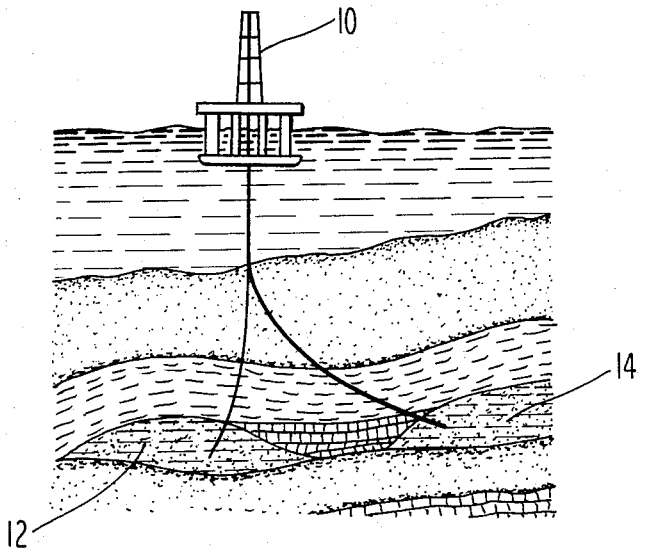
FIGS. 1*a–c* show several directional drilling operations in which the method of the invention might find use.
Figure 1B:
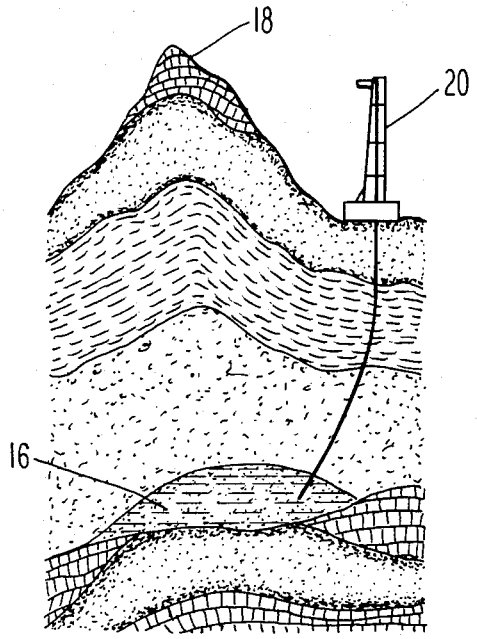
Figure 1C:
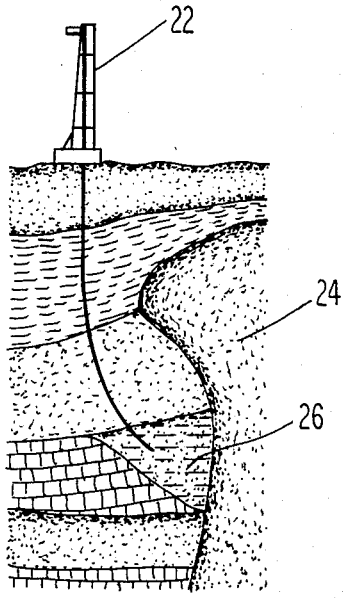

As mentioned above, FIG. 1 shows several operations in which drilling at an angle to the vertical may be desirably performed. For example, in FIG. 1*a* a floating oil platform 10 is used to access several different deposits 12 and 14 from the same location. As is well understood, these off-shore installations are extremely expensive and their utility is much increased if they can be used to drill several wells. FIG. 1*b* shows how drilling at an angle can allow a rig 20 to access a reservoir 16 located directly beneath an inaccessible location as at 18, and FIG. 1*c* shows how drilling at an angle from a rig 22 can bypass a salt dome 24 to access a reservoir 26, it being undesirable to drill directly through the highly corrosive salt dome.

Figure 3:
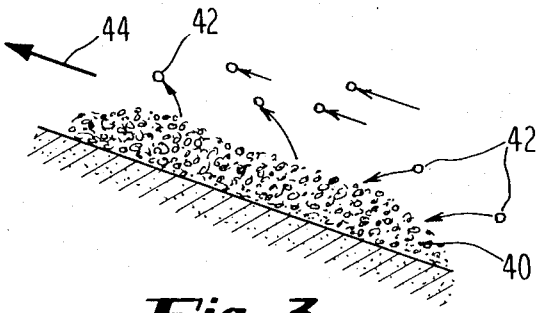
FIG. 3 shows an enlargement of a section of the cuttings bed.
Figure 2:
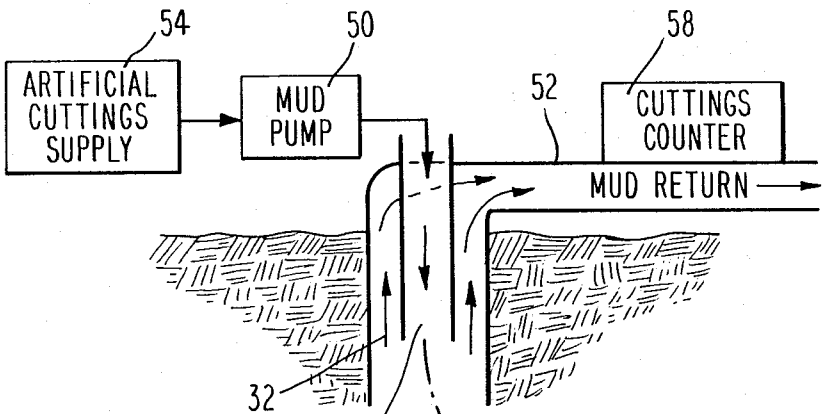
FIG. 2 shows an enlarged view of the upper and lower terminations of the drill string.
Figure 2:
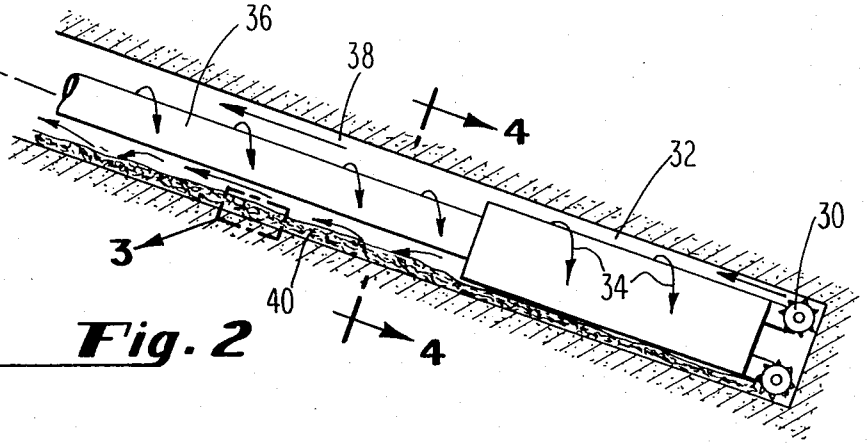
Figure 4:
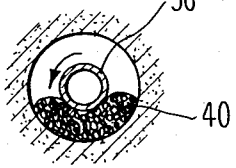
FIG. 4 shows a cross-sectional view taken along the line 4—4 of FIG. 2.

The art has developed many useful techniques for drilling at an angle and these form no part of the present invention. Rather, the present invention relates to monitoring the rate of cuttings removed from these angled wells, which, as discussed above, can frequently be a severe problem. FIG. 2 shows how these problems arise. There it will be observed that a drill bit 30 is at the bottom of a well bore 32. As the drill 30 is turned, as indicated by the arrows 34, cuttings are generated. Drilling mud passed down through the center of the drill string 36 tends to wash the cuttings out around the drill head 30 and flush them up the well bore 32. However, the fact that the well is at an angle to the vertical means that the mud preferentially flows up along the higher side of the drill string 36, as noted at 38, and hence a bed of cuttings 40 tends to build up on the lower side of the well bore. FIG. 3 shows a more detailed model of how this bed of cuttings 40 is built up. Some cuttings 42 are carried by the bed 40 by the mud, while some are added to the bed 40 and some are removed from the bed. In general, drilling at an angle frequently suffers from build up of the cuttings bed 40. If this is allowed to persist for too long, it may be impossible to remove the drill head 30 which, as shown, typically has a much larger diameter than does the drill string 36. It is also possible that the build up of the cuttings bed can force the drill string 36 out of its alignment. This is shown in FIG. 4 in a view taken along line 4—4 of FIG. 2, where it will be seen that the cuttings bed 40 is in direct contact with the drill string 36.

As noted above, the prior art shows various methods for dealing with the problem of cuttings build up but provides no method for monitoring whether the cuttings are being removed. The present invention provides such a method.

The apparatus shown at the left half of FIG. 2 shows how this can be done. A mud pump 50 is used to supply the drilling mud under pressure to the inside of the drill string 36. It passes downwardly as discussed above, is forced out around the bottom of the drill bit 30 and sweeps the cuttings back up through the annulus formed in the well bore 32 around the drill string 36 to a mud return indicated at 52. Mud pumps are typically provided with a hopper or hatch into which one may inject additives for various purposes connected with the efficient drilling of the well. In the present embodiment, the artificial cuttings are added as at 54 at a controlled rate so that the mud injected into the drill string 36 has a known content of artificial cuttings. Machinery is commercially available, for example, machinery for regular supply of machine parts to assembly lines, which may readily be adapted to supply a controllable number of cuttings to the mud pump, e.g. on each stroke thereof. As discussed above, the cuttings added at 54 are selected having density and size similar to the drilling cuttings. The artificial cuttings might in a preferred embodiment comprise a composite material, in which an iron or steel core is coated with nylon. The iron or steel core permits ready separation of the artificial cuttings from the mud returned, e.g., by use of a simple magnetic device for attracting and holding the iron-cored artificial cuttings, where they may be counted by any suitable cuttings counter 58. The nylon coating would prevent corrosion of the magnetic core.

Figure 5:
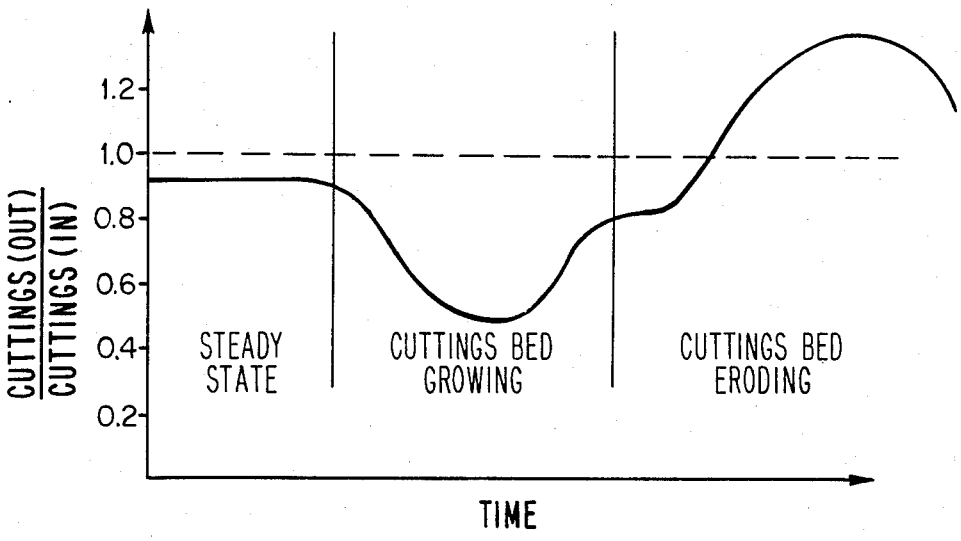
FIG. 5 shows a graph of the ratio of the cuttings injected to those removed versus time for various well drilling conditions.

If the number of cuttings removed over time is compared to the number injected, one is provided with an indication of whether the cuttings generated in the drilling operation are being removed efficiently. This is shown schematically in the graph of FIG. 5 where Cuttings(Out)/Cuttings(In), both expressed per unit time, is graphed along the ordinant versus time along the abscissa. Where the ratio is fairly constant, as in the leftmost portion of the graph, FIG. 5, the cuttings bed, is neither growing nor being eroded. If the ratio drops over time, as in the second sector, one may conclude that the cuttings bed is growing, whereas if it increases over time as in the third section, the cuttings bed is being eroded, perhaps by addition of an additive meant to cause this erosion to occur. In this way the method of the invention can be used to monitor the efficacy of certain steps taken to improve cuttings removal.

Figure 6:
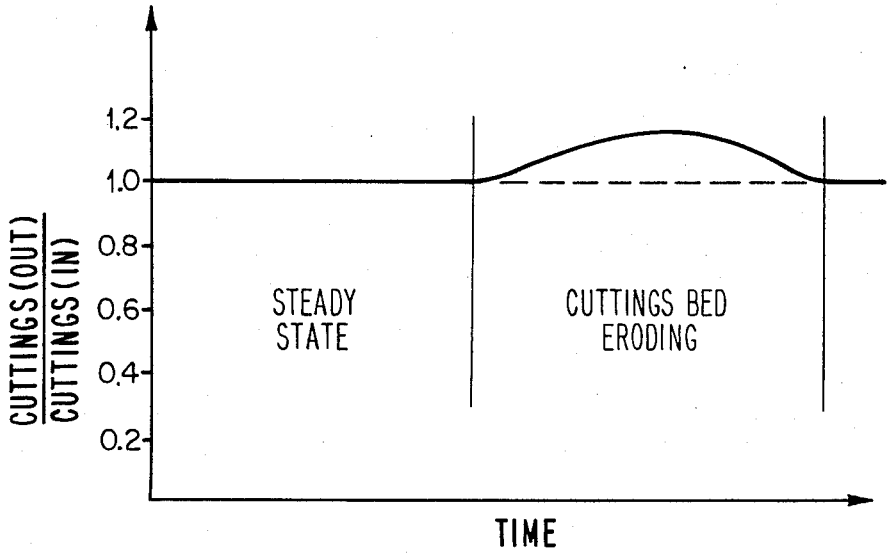
FIG. 6 shows a graph of the same ratio versus time, for circulation of the mud without drilling.

FIG. 6 shows a similar graph as might be made with respect to simple circulation of the mud; that is, it might be decided to discontinue drilling for a period of time in order to flush the cuttings out, for example, if it were determined that the cuttings bed had grown to a point where it might cause a problem. Here, if the ratio of Cuttings(Out) to Cuttings(In) is constant, as in the left half of the diagram, no net removal is being accomplished. If, as on the right, the ratio increases, the cuttings bed being eroded; for example, if an additive is being used, it may be determined that the additive is having the desired effect.

Those skilled in the art will recognize that there has been described a method for monitoring the growth or erosion of a cuttings bed as required by the objects of the invention listed above. Those skilled in the art will furthermore recognize that various improvements and modifications can be made to the details of practice of the invention described above, and therefore that the above description should not be taken as a limitation on the scope of the invention but only as exemplary thereof. The scope of the invention is more properly limited by the following claims.

We claim:

1. Method for monitoring the growth or erosion of a cuttings bed in a well being drilled in the earth comprising the steps of:

injecting artificial cuttings distinguishable from cuttings generated during said drilling operation and having a density and size comparable to the cuttings generated during the drilling operation into a stream of drilling fluid pumped into said well during drilling to wash away cuttings generated during drilling; and monitoring the rate of return of said artificial cuttings with respect to the rate of injection thereof.

2. The method of claim 1 wherein said artificial cuttings are separable from the cuttings generated by drilling by magnetic means.

3. The method of claim 1 wherein said artificial cuttings injected are a nylon/iron composite material.

4. Method for evaluation of the efficacy of steps taken to remove cuttings from a well comprising the steps of:

supplying drilling fluid to said well to remove said cuttings therefrom;

injecting artificial cuttings of a density and size similar to cuttings generated in drilling of said well and being distinguishable therefrom into the stream of drilling fluid at a controlled rate;

monitoring the number of said artificial cuttings included in the return stream of said drilling fluid; and comparing the range of their return with the rate of injection of said artificial cuttings, whereby an indication of the efficacy of the removal of cuttings generated during drilling is provided.

5. The method of claim 4 wherein said artificial cuttings are distinguishable from cuttings generated during drilling operations by magnetic means.

6. The method of claim 5 wherein said artificial cuttings are an iron/nylon composite material.

* * * * *